US012660900B2

(12) United States Patent
Weber

(10) Patent No.: US 12,660,900 B2
(45) Date of Patent: Jun. 23, 2026

(54) GEMSTONE DISPLAY SYSTEM AND METHOD

(71) Applicant: Brilliant Earth, LLC, San Francisco, CA (US)

(72) Inventor: Jessica Weber, Mesa, AZ (US)

(73) Assignee: BRILLIANT EARTH, LLC, San Francisco, CA (US)

( * ) Notice: Subject to any disclaimer, the term of this patent is extended or adjusted under 35 U.S.C. 154(b) by 0 days.

(21) Appl. No.: 18/782,802

(22) Filed: Jul. 24, 2024

(65) Prior Publication Data

US 2026/0026589 A1 Jan. 29, 2026

(51) Int. Cl.
*A45C 11/16* (2006.01)
*A44C 17/00* (2006.01)
(Continued)

(52) U.S. Cl.
CPC ..... *A45C 11/16* (2013.01); *A44C 17/008* (2013.01); *A45C 13/005* (2013.01); *A45C 13/02* (2013.01);
(Continued)

(58) Field of Classification Search
CPC ... A44C 15/00; A44C 15/0015; A44C 15/005; A44C 15/0055; A44C 17/001; A44C 17/003; A44C 17/02; A44C 17/0283; A44C 17/04; A44C 17/043; A44C 25/002; A44C 25/008; A44C 27/00; A44C 27/001; A44C 5/003; A44C 5/14; A44C 5/147; A44C 5/2085; A44C 9/0069; A44C 1/00; A44C 11/00; A44C 15/004; A44C 17/00; A44C 17/002; A44C 17/005; A44C 17/006; A44C 17/007; A44C 17/008; A44C 17/0208; A44C 17/0216; A44C 17/0225; A44C 17/0233; A44C 17/0258; A44C 17/0275; A44C 17/046; A44C 25/00; A44C 25/001; A44C 25/004; A44C 27/007; A44C 5/00; A44C 5/0007; A44C 5/0015;
(Continued)

(56) References Cited

U.S. PATENT DOCUMENTS 4,282,975 A * 8/1981 Ovadia ..... B65D 1/36 206/509
5,143,212 A * 9/1992 Roberts ..... G01N 21/278 434/386
(Continued)

FOREIGN PATENT DOCUMENTS

JP 2020518529 A * 6/2020 ..... B65D 71/70
WO WO-9007288 A1 * 7/1990 ..... B42D 25/36
WO WO-2019236241 A1 * 12/2019 ..... A21B 3/139

*Primary Examiner* — Anthony D Stashick
*Assistant Examiner* — Marcos Javier Rodriguez Molina
(74) *Attorney, Agent, or Firm* — Tucker Ellis LLP

(57) ABSTRACT

Provided is a jewelry display system including a display device for storing a plurality of clear display cards. Each of the plurality of display cards displays or includes a plurality of precious stones in order of progressively increasing carat weight or size. Each display card includes a respective cut of precious stone so that a user may use the display cards to view precious stones of different cuts, carat weights, and sizes over the top of the user's ring finger. The display cards may further include magnets to removably couple the display cards within the display device.

20 Claims, 15 Drawing Sheets

(51) Int. Cl.

| | |
|---|---|
| ***A45C 13/00*** | (2006.01) |
| ***A45C 13/02*** | (2006.01) |
| ***A47F 7/02*** | (2006.01) |
| ***A47F 7/03*** | (2006.01) |
| ***B65D 25/04*** | (2006.01) |
| ***B65D 55/02*** | (2006.01) |

(52) U.S. Cl.
CPC ..... *A47F 7/03* (2013.01); *B65D 25/04* (2013.01); *B65D 55/02* (2013.01)

(58) Field of Classification Search
CPC ..... A44C 5/2071; A44C 7/00; A44C 9/00; A44C 9/003; A44C 9/0053; A44C 9/0084; A44C 9/02; A44D 2203/00; A45C 1/04; A45C 11/00; A45C 11/001; A45C 11/002; A45C 11/003; A45C 11/008; A45C 11/10; A45C 11/16; A45C 11/20; A45C 11/34; A45C 11/36; A45C 13/00; A45C 13/001; A45C 13/02; A45C 13/10; A45C 13/1069; A45C 13/1084; A45C 13/26; A45C 13/36; A45C 13/42; A45C 15/00; A45C 2011/007; A45C 2013/025; A45C 2013/026; A45C 2013/1015; A45C 2013/306; A45C 2200/10; A45C 5/005; A45C 5/03; A45C 5/06; A45C 5/065; A45C 13/005; A45C 13/18; A45C 15/06; A47F 1/12; A47F 1/126; A47F 10/06; A47F 11/00; A47F 11/06; A47F 11/10; A47F 3/001; A47F 3/002; A47F 3/004; A47F 3/005; A47F 3/06; A47F 3/063; A47F 3/08; A47F 3/085; A47F 3/10; A47F 3/11; A47F 3/12; A47F 3/14; A47F 5/0087; A47F 5/02; A47F 5/025; A47F 5/04; A47F 5/0807; A47F 5/0815; A47F 5/0884; A47F 5/10; A47F 7/00; A47F 7/02; A47F 7/022; A47F 7/024; A47F 7/03; A47F 7/147; A47F 9/045; A47F 5/00; A47F 5/112; A47F 5/114; A47F 5/116; B65D 1/0207; B65D 1/0215; B65D 1/0223; B65D 1/023; B65D 1/0246; B65D 1/04; B65D 1/06; B65D 1/12; B65D 1/16; B65D 1/22; B65D 1/225; B65D 1/24; B65D 1/243; B65D 1/26; B65D 1/265; B65D 1/34; B65D 1/36; B65D 1/40; B65D 1/42; B65D 11/02; B65D 11/10; B65D 11/12; B65D 11/16; B65D 11/18; B65D 11/1833; B65D 11/1846; B65D 11/1873; B65D 11/188; B65D 11/22; B65D 13/04; B65D 15/00; B65D 17/4012; B65D 19/00; B65D 19/0002; B65D 19/0004; B65D 19/001; B65D 19/0012; B65D 19/0018; B65D 19/0026; B65D 19/0028; B65D 19/0038; B65D 19/004; B65D 19/0048; B65D 19/0055; B65D 19/02; B65D 19/04; B65D 19/06; B65D 19/10; B65D 19/12; B65D 19/38; B65D 19/385; B65D 19/40; B65D 19/42; B65D 19/44; B65D 21/0201; B65D 21/0202; B65D 21/0204; B65D 21/0205; B65D 21/0209; B65D 21/0212; B65D 21/0213; B65D 21/0215; B65D 21/0217; B65D 21/0223; B65D 21/0228; B65D 21/023; B65D 21/0233; B65D 21/0237; B65D 21/062; B65D 21/066; B65D 21/083; B65D 21/086; B65D 2201/00; B65D 2203/00; B65D 2203/02; B65D 2203/06; B65D 2203/10; B65D 2203/12; B65D 2205/02; B65D 2207/00; B65D 2211/00; B65D 2213/02; B65D 2231/005; B65D 2251/0003; B65D 2251/08; B65D 2251/1016; B65D 2251/1025; B65D 2251/1033; B65D 2251/1058; B65D 23/02; B65D 23/08; B65D 23/0842; B65D 23/0857; B65D 23/0864; B65D 23/0878; B65D 23/104; B65D 23/12; B65D 23/14; B65D 2313/00; B65D 2313/02; B65D 2313/04; B65D 2401/00; B65D 2401/05; B65D 2401/10; B65D 2401/30; B65D 25/00; B65D 25/005; B65D 25/02; B65D 25/04; B65D 25/06; B65D 25/08; B65D 25/10; B65D 25/101; B65D 25/105; B65D 25/106; B65D 25/107; B65D 25/108; B65D 25/14; B65D 25/16; B65D 25/20; B65D 25/205; B65D 25/22; B65D 25/24; B65D 25/28; B65D 25/2805; B65D 25/2811; B65D 25/282; B65D 25/2835; B65D 25/2841; B65D 25/2858; B65D 25/2876; B65D 25/2888; B65D 25/2894; B65D 25/36; B65D 25/38; B65D 25/52; B65D 25/54; B65D 2501/24019; B65D 2501/2407; B65D 2501/24082; B65D 2501/24108; B65D 2501/24114; B65D 2501/24127; B65D 2501/24133; B65D 2501/24152; B65D 2501/24184; B65D 2501/24254; B65D 2501/24261; B65D 2501/24324; B65D 2501/2435; B65D 2501/24541; B65D 2501/24687; B65D 2501/24777; B65D 2501/24796; B65D 2501/24872; B65D 2517/0014; B65D 2517/0049; B65D 2517/0052; B65D 2517/0062; B65D 2519/00019; B65D 2519/00024; B65D 2519/00029; B65D 2519/00034; B65D 2519/00039; B65D 2519/00044; B65D 2519/00054; B65D 2519/00059; B65D 2519/00064; B65D 2519/00069; B65D 2519/00074; B65D 2519/00079; B65D 2519/00094; B65D 2519/00104; B65D 2519/00159; B65D 2519/00164; B65D 2519/00174; B65D 2519/00199; B65D 2519/00208; B65D 2519/00228; B65D 2519/00268; B65D 2519/00273; B65D 2519/00288; B65D 2519/00293; B65D 2519/00303; B65D 2519/00308; B65D 2519/00318; B65D 2519/00323; B65D 2519/00333; B65D 2519/00338; B65D 2519/00373; B65D 2519/00407; B65D 2519/00427; B65D 2519/00497; B65D 2519/00502; B65D 2519/00512; B65D 2519/00552; B65D 2519/00562; B65D 2519/00567; B65D 2519/00572; B65D 2519/00597; B65D 2519/00611; B65D 2519/00621; B65D 2519/00641; B65D 2519/00656; B65D 2519/00661; B65D 2519/00711; B65D 2519/00761; B65D 2519/00771; B65D 2519/00776; B65D 2519/00791; B65D 2519/00796; B65D 2519/008; B65D 2519/00805; B65D 2519/0081; B65D 2519/00815;

B65D 2519/0082; B65D 2519/0083; B65D 2519/0086; B65D 2519/0087; B65D 2519/00875; B65D 2519/009; B65D 2519/0091; B65D 2519/00935; B65D 2519/0094; B65D 2519/0096; B65D 2519/00965; B65D 2519/00985; B65D 2525/283; B65D 2525/287; B65D 2543/00092; B65D 2543/00185; B65D 2543/00194; B65D 2543/00203; B65D 2543/00212; B65D 2543/0024; B65D 2543/00277; B65D 2543/00296; B65D 2543/00314; B65D 2543/00361; B65D 2543/00444; B65D 2543/00509; B65D 2543/00518; B65D 2543/00527; B65D 2543/00537; B65D 2543/00546; B65D 2543/0062; B65D 2543/00648; B65D 2543/00685; B65D 2543/0074; B65D 2543/00796; B65D 2543/00972; B65D 2543/0099; B65D 2565/382; B65D 2565/388; B65D 2571/00018; B65D 2571/00141; B65D 2571/0066; B65D 2571/00728; B65D 2571/00919; B65D 2575/3254; B65D 2577/043; B65D 2577/046; B65D 2577/205; B65D 2577/2083; B65D 2581/3416; B65D 2581/3417; B65D 2581/3424; B65D 2581/3425; B65D 2581/3437; B65D 2581/344; B65D 2581/3441; B65D 2581/3447; B65D 2581/3456; B65D 2581/3458; B65D 2581/3462; B65D 2581/3466; B65D 2581/3467; B65D 2581/3471; B65D 2581/3472; B65D 2581/3475; B65D 2581/3489; B65D 2581/3494; B65D 2581/3498; B65D 2583/0427; B65D 2583/0468; B65D 2585/366; B65D 2585/6835; B65D 2585/6897; B65D 2585/86; B65D 2585/88; B65D 2588/12; B65D 2590/0058; B65D 2590/0066; B65D 2590/0083; B65D 27/00; B65D 3/22; B65D 3/28; B65D 31/00; B65D 31/16; B65D 31/18; B65D 33/00; B65D 33/004; B65D 33/008; B65D 33/01; B65D 33/02; B65D 33/12; B65D 33/16; B65D 33/18; B65D 35/02; B65D 35/10; B65D 35/28; B65D 35/30; B65D 37/00; B65D 41/02; B65D 41/04; B65D 41/16; B65D 41/22; B65D 43/02; B65D 43/0202; B65D 43/0212; B65D 43/022; B65D 43/0235; B65D 43/0254; B65D 43/0256; B65D 43/0277; B65D 43/14; B65D 43/16; B65D 43/161; B65D 43/162; B65D 43/163; B65D 43/164; B65D 43/22; B65D 43/24; B65D 43/26; B65D 45/00; B65D 45/16; B65D 49/12; B65D 5/00; B65D 5/0005; B65D 5/001; B65D 5/006; B65D 5/0085; B65D 5/009; B65D 5/0209; B65D 5/029; B65D 5/069; B65D 5/18; B65D 5/2009; B65D 5/2047; B65D 5/22; B65D 5/24; B65D 5/246; B65D 5/28; B65D 5/321; B65D 5/322; B65D 5/326; B65D 5/327; B65D 5/328; B65D 5/36; B65D 5/38; B65D 5/40; B65D 5/4204; B65D 5/4212; B65D 5/422; B65D 5/4225; B65D 5/4233; B65D 5/425; B65D 5/427; B65D 5/4291; B65D 5/44; B65D 5/441; B65D 5/443; B65D 5/445; B65D 5/48016; B65D 5/4804; B65D 5/48048; B65D 5/50; B65D 5/5014; B65D 5/503; B65D 5/5035; B65D 5/5038; B65D 5/52; B65D 5/5213; B65D 5/524; B65D 5/5266; B65D 5/54; B65D 5/542; B65D 5/5425; B65D 5/5455; B65D 5/563; B65D 5/60; B65D 5/64; B65D 5/643; B65D 5/6626; B65D 5/6697; B65D 5/68; B65D 5/72; B65D 5/725; B65D 50/04; B65D 51/00; B65D 51/002; B65D 51/005; B65D 51/04; B65D 51/1672; B65D 51/1683; B65D 51/20; B65D 51/24; B65D 51/244; B65D 51/245; B65D 51/248; B65D 51/249; B65D 51/26; B65D 51/28; B65D 51/32; B65D 53/00; B65D 53/02; B65D 55/02; B65D 55/022; B65D 55/024; B65D 55/026; B65D 55/028; B65D 55/06; B65D 55/14; B65D 55/16; B65D 65/02; B65D 65/38; B65D 65/40; B65D 65/403; B65D 65/42; B65D 65/46; B65D 65/466; B65D 67/00; B65D 7/10; B65D 71/00; B65D 71/0037; B65D 71/004; B65D 71/0096; B65D 71/08; B65D 71/20; B65D 71/36; B65D 71/70; B65D 73/00; B65D 73/0035; B65D 73/0071; B65D 73/02; B65D 75/00; B65D 75/008; B65D 75/04; B65D 75/20; B65D 75/30; B65D 75/305; B65D 75/32; B65D 75/326; B65D 75/327; B65D 75/36; B65D 75/366; B65D 75/368; B65D 75/38; B65D 75/52; B65D 75/525; B65D 75/527; B65D 75/54; B65D 75/56; B65D 75/566; B65D 75/58; B65D 75/5855; B65D 75/5861; B65D 75/5866; B65D 75/5872; B65D 75/5877; B65D 75/5883; B65D 75/5888; B65D 75/5894; B65D 77/00; B65D 77/006; B65D 77/04; B65D 77/0406; B65D 77/042; B65D 77/044; B65D 77/046; B65D 77/0466; B65D 77/0486; B65D 77/20; B65D 77/2008; B65D 77/2024; B65D 77/24; B65D 77/28; B65D 79/00; B65D 79/02; B65D 81/00; B65D 81/02; B65D 81/022; B65D 81/027; B65D 81/03; B65D 81/05; B65D 81/051; B65D 81/052; B65D 81/07; B65D 81/075; B65D 81/113; B65D 81/127; B65D 81/133; B65D 81/18; B65D 81/2015; B65D 81/2038; B65D 81/2069; B65D 81/2076; B65D /

USPC ... 206/5, 6, 7, 81, 82, 83, 1.5, 1.7, 1.8, 101, 206/102, 104, 105, 11, 139, 144, 145, 206/147, 15.2, 150, 151, 152, 153, 156, 206/158, 161, 162, 175, 18, 193, 194, 206/199, 204, 205, 207, 208, 209, 210, 206/213.1, 214, 215, 216, 217, 219, 220, 206/221, 222, 223, 224, 227, 228, 229, 206/232, 234, 235, 236, 242, 244, 246, 206/250, 254, 256, 264, 269, 271, 273, 206/277, 278, 280, 286, 288, 292, 298, 206/299, 301, 303, 305, 307, 307.1, 206/308.1, 308.2, 308.3, 309, 310, 311, 206/312, 313, 315.1, 315.11, 315.3,

206/315.6, 315.9, 316.1, 317, 320, 335, 206/338, 339, 340, 342, 345, 347, 348, 206/349, 350, 354, 355, 359, 361, 363, 206/364, 365, 366, 368, 369, 37, 370, 206/372, 373, 375, 376, 377, 378, 379, 206/38, 380, 381, 382, 386, 387.1, 206/387.11, 387.12, 387.13, 387.14, 206/387.15, 39.7, 391, 393, 394, 396, 206/397, 403, 404, 407, 408, 410, 416, 206/418, 419, 423, 424, 425, 426, 427, 206/429, 430, 431, 432, 433, 434, 438, 206/439, 440, 443, 445, 446, 447, 449, 206/45.2, 45.23, 45.24, 45.25, 45.27, 206/45.28, 45.29, 450, 451, 453, 454, 206/455, 456, 457, 458, 459.1, 459.5, 206/460, 461, 462, 463, 466, 467, 469, 206/470, 471, 472, 473, 475, 477, 478, 206/479, 480, 481, 482, 484, 484.1, 206/484.2, 485, 486, 487, 488, 489, 493, 206/494, 495, 496, 497, 499, 5.1, 500, 206/501, 503, 504, 505, 506, 507, 508, 206/509, 511, 512, 514, 515, 518, 519, 206/520, 521, 521.1, 521.15, 521.2, 206/521.4, 521.6, 521.7, 521.8, 521.9, 206/522, 523, 524.1, 524.2, 524.3, 524.4, 206/524.5, 524.6, 524.7, 524.8, 525, 526, 206/527, 528, 531, 532, 534, 534.1, 206/534.2, 535, 538, 539, 540, 541, 545, 206/546, 548, 549, 551, 553, 557, 558, 206/559, 560, 561, 562, 563, 564, 565, 206/566, 567, 568, 569, 570, 571, 574, 206/575, 576, 577, 578, 579, 581, 583, 206/584, 585, 586, 588, 589, 590, 591, 206/592, 593, 594, 597, 599, 6.1, 600, 206/63.3, 63.5, 701, 703, 705, 706, 710, 206/711, 712, 714, 722, 724, 725, 733, 206/734, 736, 737, 738, 745, 747, 748, 206/749, 750, 751, 752, 753, 754, 755, 206/756, 757, 758, 759, 760, 762, 763, 206/764, 765, 768, 769, 77.1, 771, 772, 206/774, 775, 776, 779, 780, 782, 784, 206/803, 804, 805, 806, 807, 809, 811, 206/812, 813, 815, 816, 817, 818, 819, 206/820, 821, 822, 823, 829, 83.5, 832, 206/85, 86, 90, 96, 231, 287.1, 294, 295, 206/351, 362.4, 38.1, 388, 411, 468, 476, 206/702, 726, 777, 778, 800; 211/1, 10, 211/104, 119.004, 126.16, 126.3, 13.1, 211/163, 26, 4, 42, 70.6, 74, 77, 86.01, 211/87.01, 88.01, DIG. 1; 63/1.11, 15, 63/26, 28, 30, 32, 34, 36; D11/133, 135, D11/139, 26, 37, 39, 89

See application file for complete search history.

(56) References Cited

U.S. PATENT DOCUMENTS

| | | | | |
|---|---|---|---|---|
| 7,987,860 | B2 * | 8/2011 | Ancorotti | H04J 3/14 206/581 |
| 2014/0284225 | A1 * | 9/2014 | Davis | B44D 3/02 206/1.8 |
| 2015/0223580 | A1 * | 8/2015 | Kinney | B65D 25/205 53/445 |
| 2016/0174675 | A1 * | 6/2016 | Bedman | A47F 3/005 206/6.1 |
| 2019/0059557 | A1 * | 2/2019 | Kehoe | A45D 40/24 |
| 2019/0142196 | A1 * | 5/2019 | Barnum | B65D 71/70 206/459.5 |
| 2020/0240068 | A1 * | 7/2020 | Sanders | B32B 1/00 |

* cited by examiner

GEMSTONE DISPLAY SYSTEM AND METHOD

FIELD OF INVENTION

Embodiments of the present invention relate generally to diamonds and other gemstones, and in particular, systems and methods for displaying diamonds and other gemstones.

BACKGROUND

Diamonds, and other precious stones, are often set into rings to create a piece of jewelry. The process involves selecting a diamond or stone based on various attributes, such as its cut, color, clarity, and carat weight. The diamond or stone is then affixed in a metal setting, which holds the stone securely in place. The ring is then sized to fit the wearer. Diamond or other gemstone rings are popular for engagements, weddings, gifts, and special occasions due to their brilliance and durability.

SUMMARY OF INVENTION

A customer or user often prefers to see a particular stone on her or his finger prior to purchasing the stone. This may be to verify, for example, that the cut, carat weight, color, or clarity of the particular stone looks desirable to the customer or user. One option for testing various stones is to mount a particular stone to a ring for trial by the customer or user. But, this takes time, and when more than one stone is involved, this method becomes commercially unreasonable. Another option could involve holding different stones on top of a customer's or user's finger for viewing purposes. But, this may be undesirable and result in lost or dropped stones. Also holding precious stones may be difficult. It may also consume more time than a customer or user wished to take. A better way to illustrate the weight, cut, color, or clarity of a precious stone to various customers or users is needed.

Embodiments of the present invention relate generally to a device and method for displaying different attributes such as cuts and weights of diamonds or other precious stones to a customer or user for viewing purposes. For instance, a display device or display case may hold a plurality of display cards. Each display card may display or hold a plurality of stones having a particular cut, each of the plurality of stones having different carat weights. The display cards may be transparent such that the customer or user can position the display card over the top of the customer's or user's finger. The display card can be used to selectively view each of the stones on the customer's or user's finger to test for size, cut, weight, and liking.

In an implementation, a jewelry display system comprises at least one display card comprising a first end, a second end opposite the first end, and a body disposed between the first and the second ends, the display card further comprising a plurality of precious stones disposed at least partly within the body, wherein at least one precious stone of the plurality of precious stones has one or more attributes different from other stones of the plurality of precious stones and the plurality of precious stones are arranged on the display card according to an ordering, and a display device comprising one or more protrusions adapted to receive the at least one display card, and the at least one display card is removably coupled to the display device.

In another implementation, the one or more attributes comprises a carat weight, a size, a precious stone clarity, or a precious stone color.

In another implementation, there are at least two display cards, each of the at least two display cards comprising a plurality of precious stones disposed at least partly within the body, wherein each precious stone is a different carat weight and each of the plurality of precious stones are arranged on each respective display card in order of progressively increasing carat weight.

In another implementation, a first display card of the at least two display cards comprises a plurality of precious stones having a first cut and a second display card of the at least two display cards comprises a plurality of precious stones having a second cut.

In another implementation, the first cut is a cushion cut and the second cut is a round cut.

In another implementation, the display device comprises a first portion and a second portion, and a hinge element to facilitate movement of the first portion with respect to the second portion, the display device having an opened position and a closed position.

In another implementation, the display device comprises a locking mechanism to lock the first portion to the second portion when the display device is in the closed position.

In another implementation, the at least one display card comprises at least one first magnet proximate the first end and at least one second magnet proximate the second end, the at least one first magnet and at least one second magnet configured to hold the at least one display card within the display device.

In another implementation, the at least one display card comprises at least one tab for removal of the at least one display card from the display device.

In another implementation, the body of the at least one display card comprises a plurality of openings, each of the plurality of openings configured to accept a portion of a respective precious stone to attach of the respective precious stones to the body of the display card.

In another implementation, each of the openings extend partially into the body of the at least one display card, each opening being sized according to a respective precious stone.

In an implementation a jewelry display system comprises a first display card comprising a first end, a second end opposite the first end, a body disposed between the first and the second ends, a first magnet proximate the first end, and a second magnet proximate the second end, the first display card further comprising a plurality of precious stones of a first cut disposed at least partly within the body, wherein each precious stone is a different carat weight and each of the plurality of precious stones are arranged on the first display card according to carat weight, a second display card comprising a first end, a second end opposite the first end, a body disposed between the first and the second ends, a first magnet proximate the first end, and a second magnet proximate the second end, the second display card further comprising a plurality of precious stones of a second cut disposed at least partly within the body, wherein each precious stone is a different carat weight and each of the plurality of precious stones are arranged on the second display card according to carat weight, a display device comprising a plurality of ribs arranged parallel to one another to create a space between the plurality of ribs to hold the first and the second display cards, the first and the second display cards are removably coupled to the display device via magnetic attraction between the first and second magnets of the first and second display cards and a respective portion of the display device.

In another implementation, each of the plurality of precious stones are Cubic Zirconia stones.

In another implementation, the first cut is different from the second cut.

In another implementation, the first cut is a cushion cut and the second cut is a round cut.

In another implementation, the display device has a first portion and a second portion, and a hinge element to facilitate movement of the first portion with respect to the second portion, the display device having an opened position and a closed position.

In another implementation, the display device comprises a locking mechanism to lock the first portion to the second portion when the display device is in the closed position.

In another implementation, the first and the second display cards each comprise at least one tab for removal of the first or second display cards from the display device.

In another implementation, the body of each of the first and the second display cards comprises a plurality of openings, each of the plurality of openings configured to accept a portion of a respective precious stone to attach the portion of the respective precious stone to the body of the respective first or second display card.

In another implementation, each of the openings extend partially into the body of the respective first or second display cards, each opening being sized according to a respective precious stone.

Other features and advantages of embodiments of the present invention will become apparent from the following detailed description, taken in conjunction with the accompanying drawings which illustrate, by way of example, features of the present invention.

DETAILED DESCRIPTION

In the following detailed description, certain example embodiments are shown and described, by way of illustration. As those skilled in the art would recognize, the described example embodiments may be modified in various ways without departing from the spirit and scope of the present invention. Accordingly, the drawings and description are to be regarded as illustrative in nature, rather than restrictive.

Embodiments of the present invention relate to a system having a display case and at least one display card for displaying a plurality of precious stones. Precious stones may refer to any precious stone, semi-precious stone, or gemstone, and may refer to diamonds in particular. Precious stones may also refer to cubic zirconia stones, which may be used to illustrate particular cuts, sizes, and carat weights of stones. It may be useful to employ cubic zirconia stones for display and trial purposes as opposed to diamonds due to the lower cost of cubic zirconia stones. It should be appreciated, however, that the term precious stones, as used in the current application, may refer to either cubic zirconia stones, diamonds, or any other precious stone or semi-precious stone without deviating from the scope of the disclosure. By way of example, and not limitation, precious stones may refer to any kind of natural or lab-created gemstone or semi-precious stone such as diamonds, cubic zirconias, emeralds, pearls, ruby stones, sapphire stones, quartz, amethyst, and the like.

Figure 1:
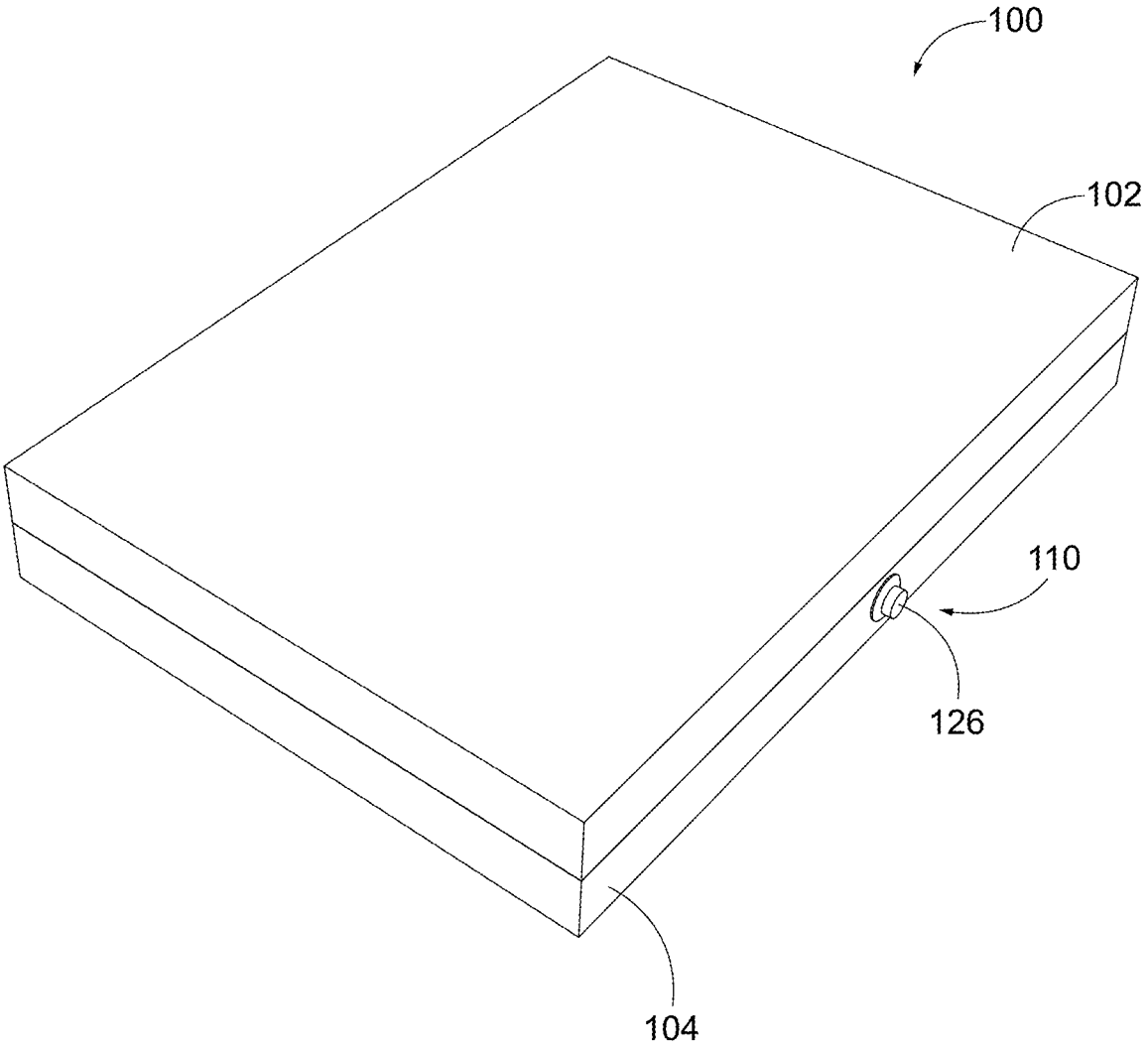
FIG. 1 is a front perspective view of an exemplary implementation of a display case in a closed position according to an embodiment as described herein.
Figure 2:
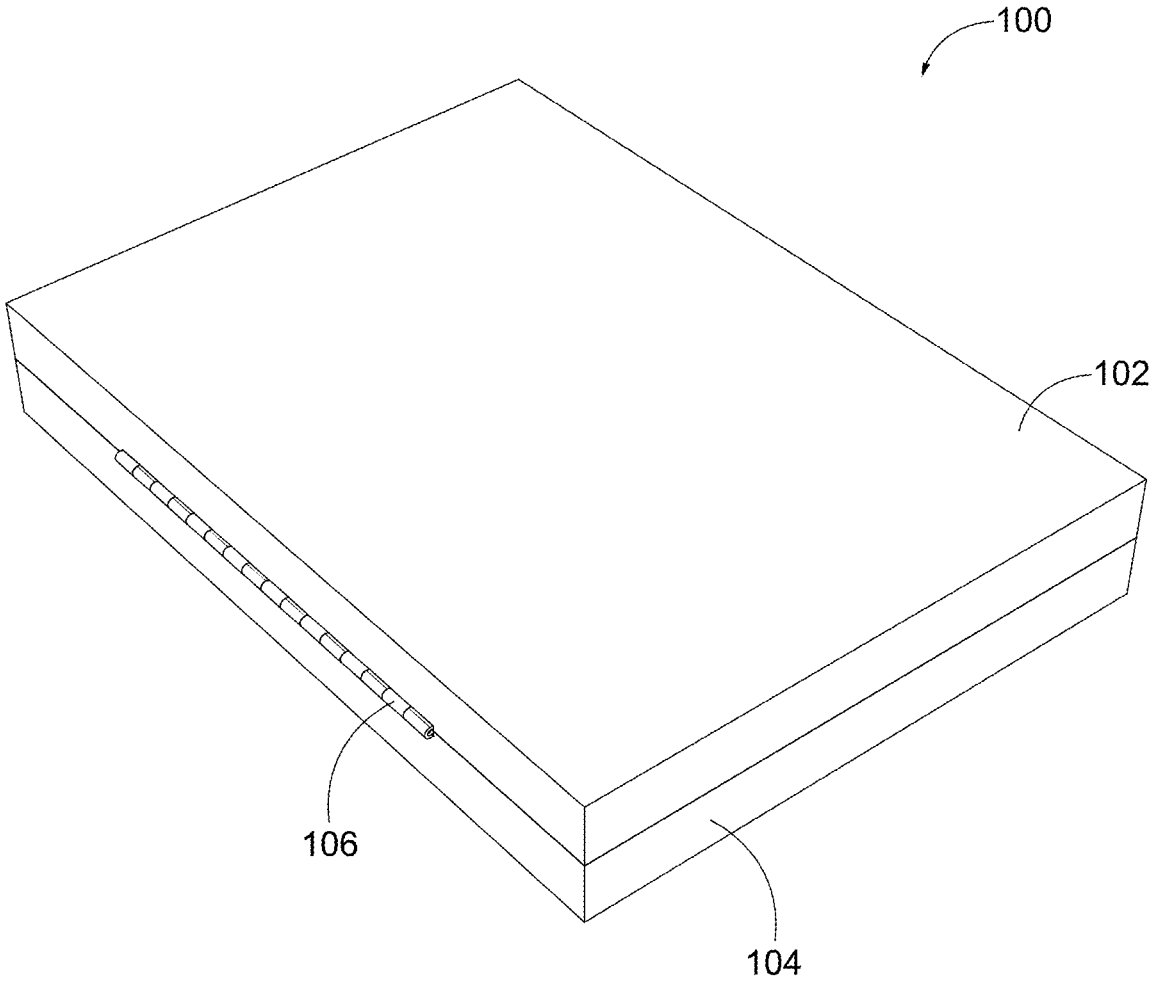
FIG. 2 is a rear perspective view of the display case in a closed position according to an embodiment as described herein.
Figure 3:
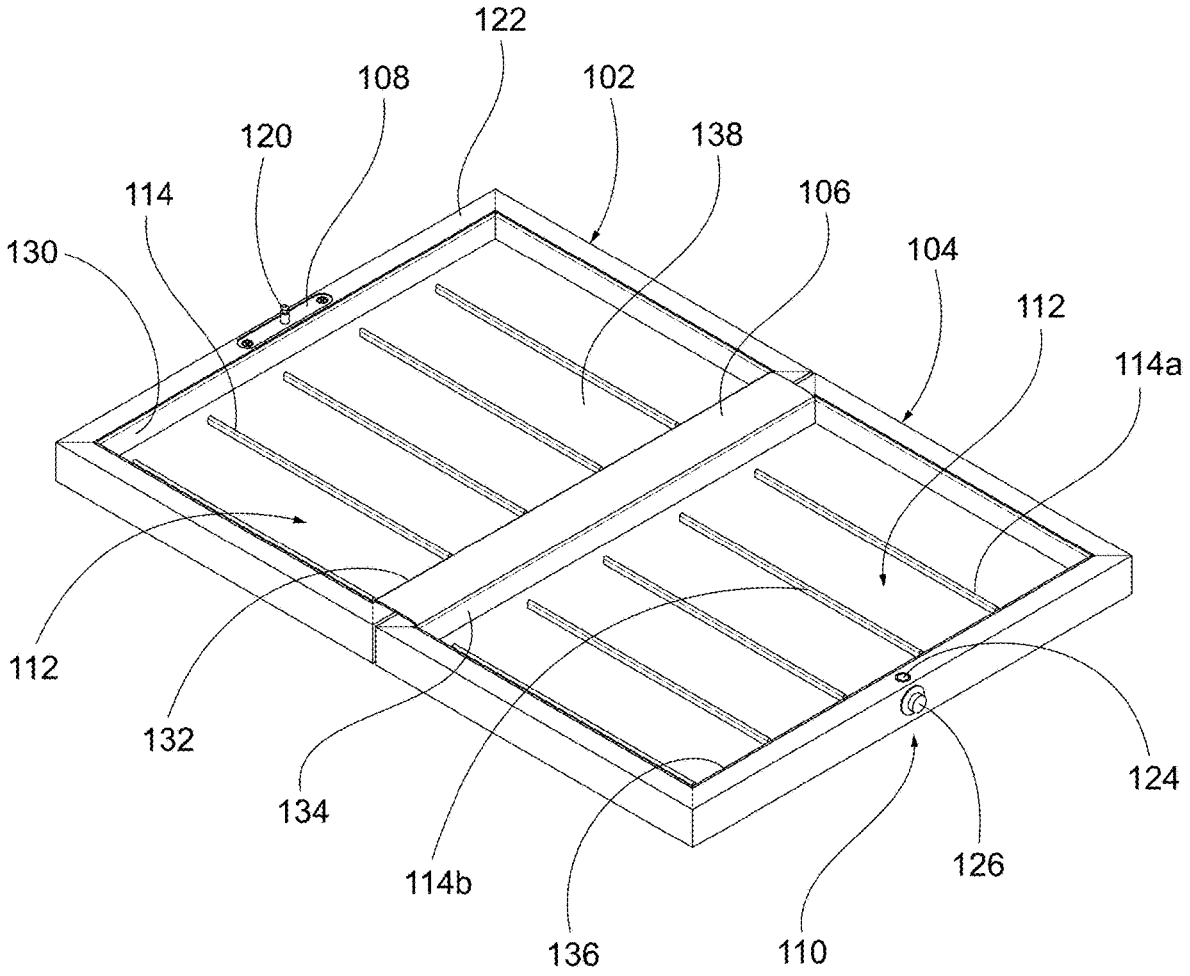
FIG. 3 is a top perspective view of the display case in an opened position according to an embodiment as described herein.
Figure 4:
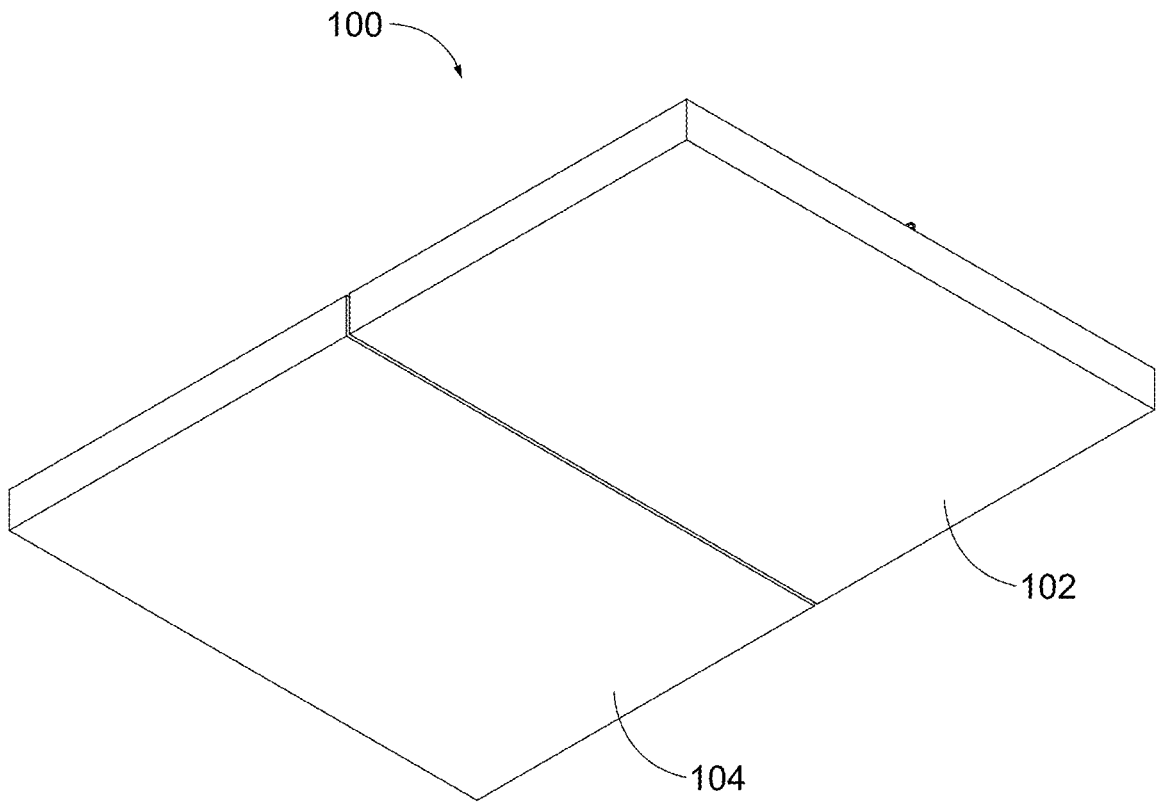
FIG. 4 is a bottom perspective view of the display case in an opened position according to an embodiment as described herein.
Figure 5:
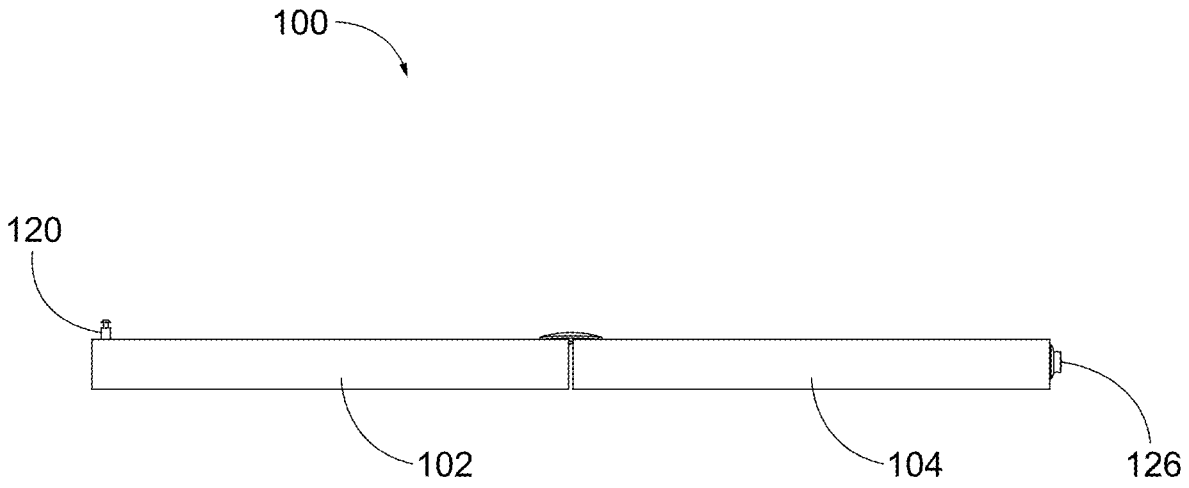
FIG. 5 is a left side view of the display case according to an embodiment as described herein.
Figure 6:
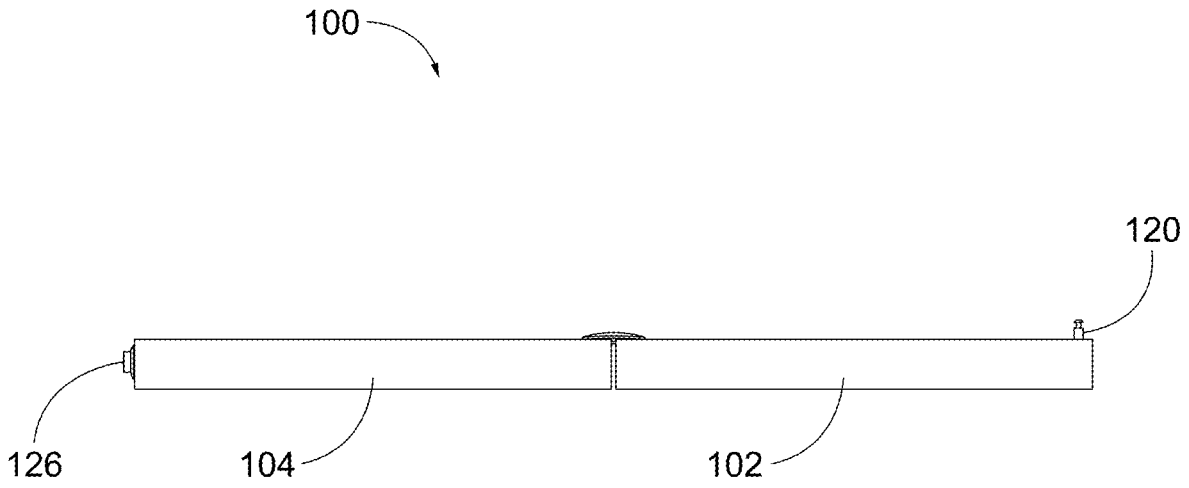
FIG. 6 is a right side view of the display case according to an embodiment as described herein.
Figure 7:
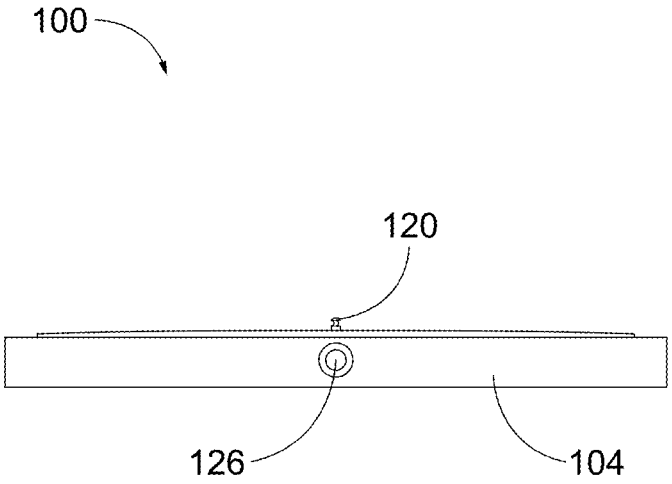
FIG. 7 is a front view of the display case according to an embodiment as described herein.
Figure 8:
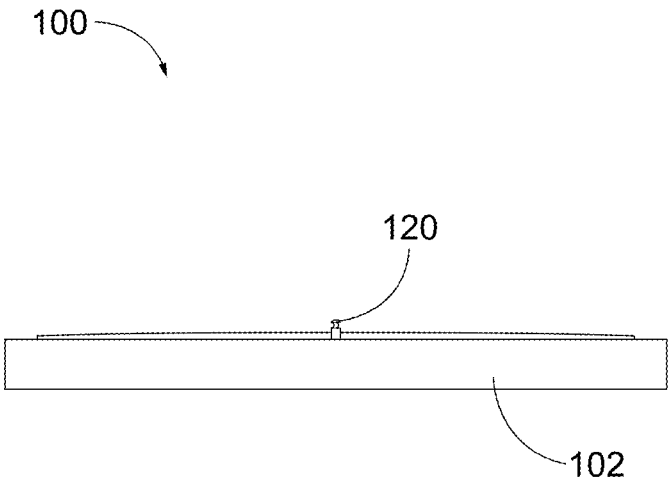
FIG. 8 is a rear view of the display case according to an embodiment as described herein.
Figure 9:
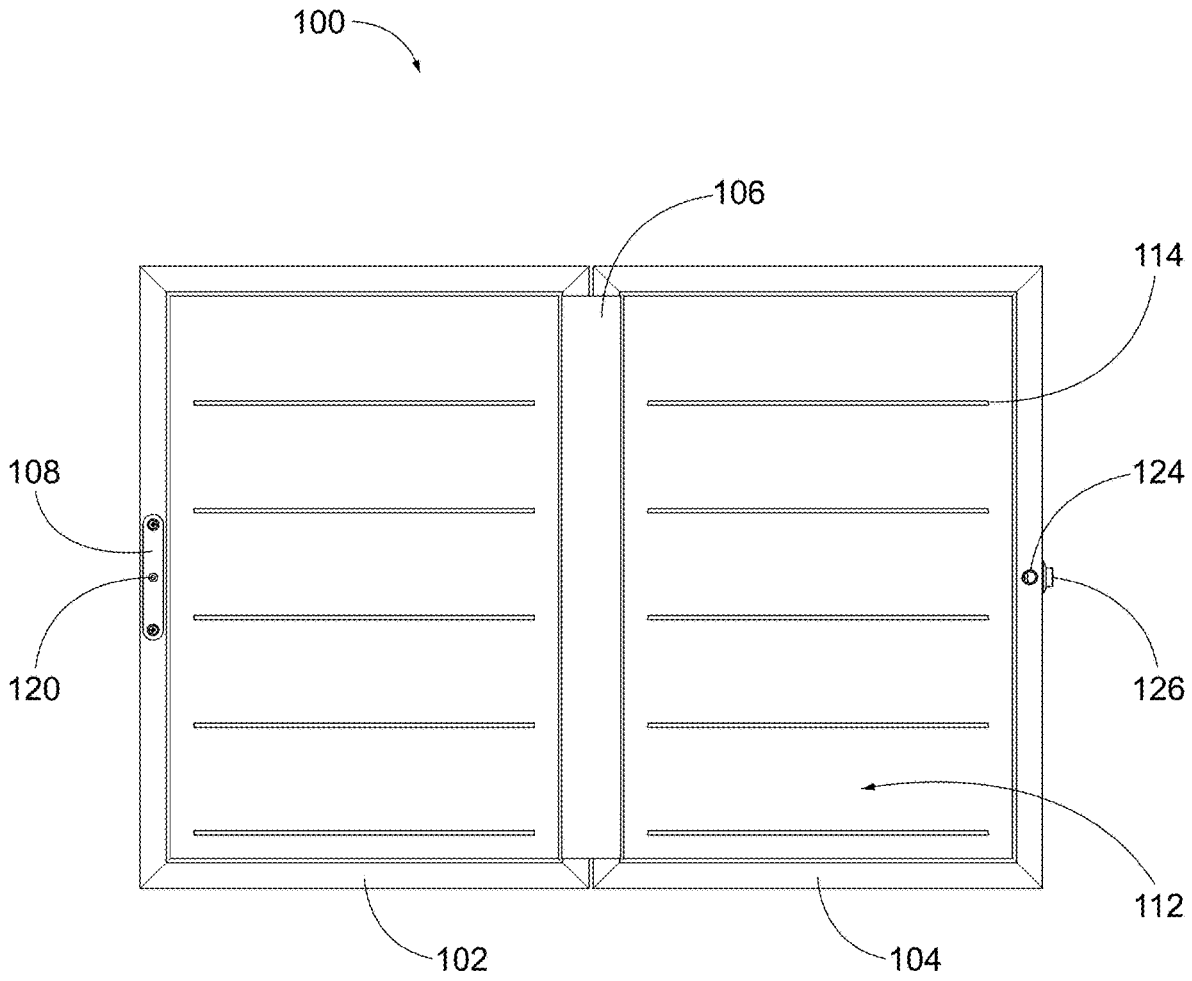
FIG. 9 is a top view of the display case according to an embodiment as described herein.
Figure 10:
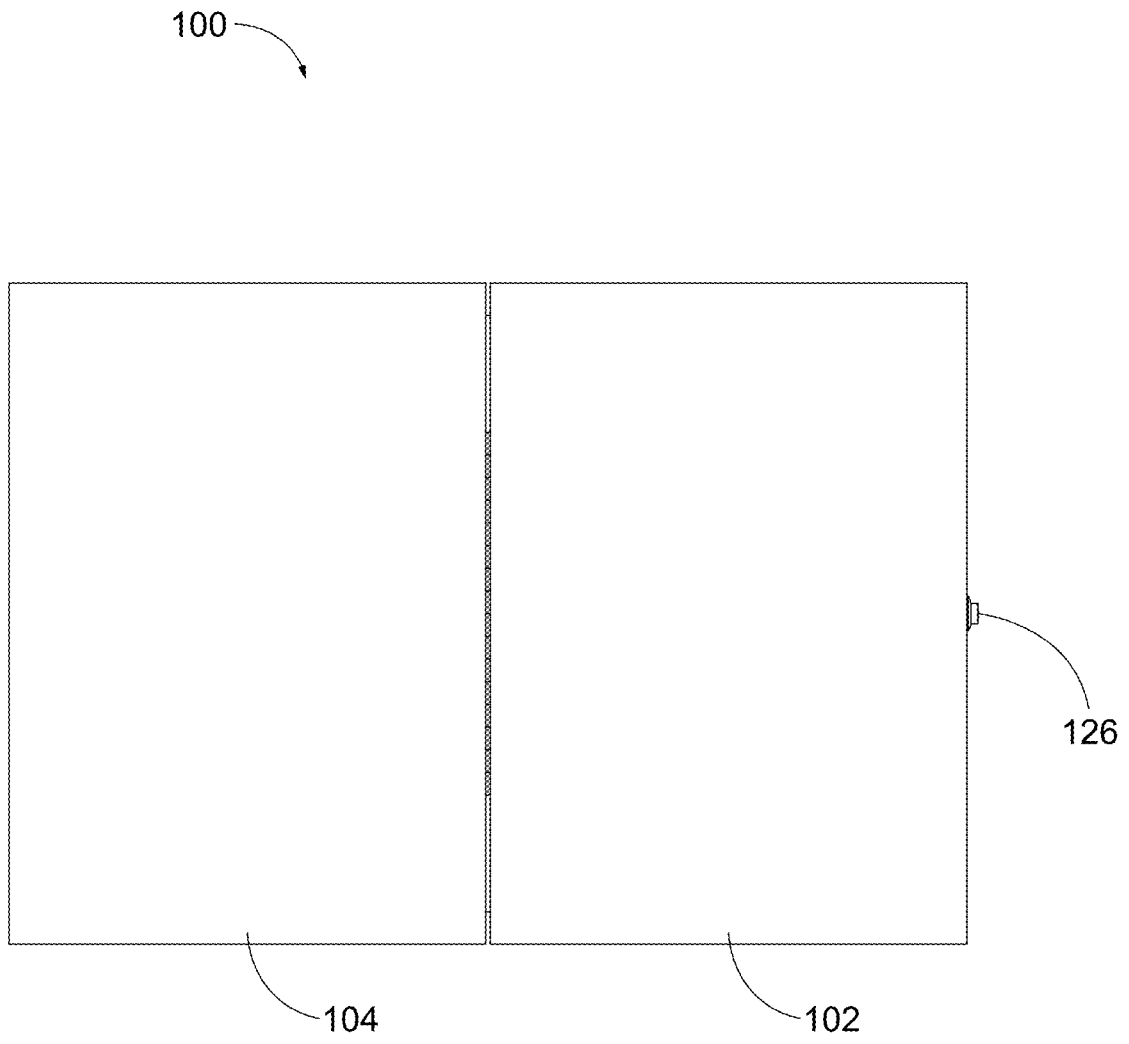
FIG. 10 is a bottom view of the display case according to an embodiment as described herein.

Turning to FIGS. 1-2, an exemplary embodiment of a display device or display case 100 is shown in a closed position according to an embodiment. The display case 100 comprises a first portion 102 and second portion 104. The first portion 102 and the second portion 104 may be rotatably attached to one another, for example, via at least one hinge element 106. The hinge element 106 may facilitate rotation of the first portion 102 with respect to the second portion 104 to allow the display case 100 to transition between an opened position and a closed position.

FIGS. 3-10 illustrate the display case 100 in an opened position according to an embodiment. As illustrated, the display case 100 may further comprise a locking feature 108 and a receiving feature 110 to facilitate locking of the display case in the closed position. The locking feature 108 may comprise an elongated portion 120 extending in a direction perpendicular to an interior surface 122 of the first portion 102. The receiving feature 110 may comprise an opening 124 and a push button 126. When in the closed position, the elongated portion 120 may engage the opening 124 to facilitate locking of the display case 100. In other words, the first portion 102 may be locked to the second portion 104 via the locking feature 108 and receiving feature 110. Pressing the push button 126 may unlock the display case 100 to allow a user to rotate or otherwise open or expand the display case 100 to the opened position. It should be appreciated that, according to an embodiment, when in the opened position, the first portion 102 and the second portion 104 may be aligned with and arranged parallel with one another such that a first end of the first portion 102 engages a first end of the second portion 104.

The display case 100 may further comprise at least one installation location 112 to facilitate the attachment or installation of at least one display card 200. Each installation location 112 may be separated from the adjacent installation location 112 with at least one protrusion or rib 114. The protrusions or ribs 114 may extend lengthwise from a first side 130 to a second side 132 of the first portion 102 and from a first side 134 to a second side 136 of the second portion 104. The ribs 114 may protrude or extend upward from an interior surface 138 of the display case 100. Ribs 114 may be located on either side of the installation locations 112 to hold in place at least one display card 200. For example, an installation location 112 may be configured to receive a display card 200 between a first rib 114*a* and a second rib 114*b*.

Figure 11:
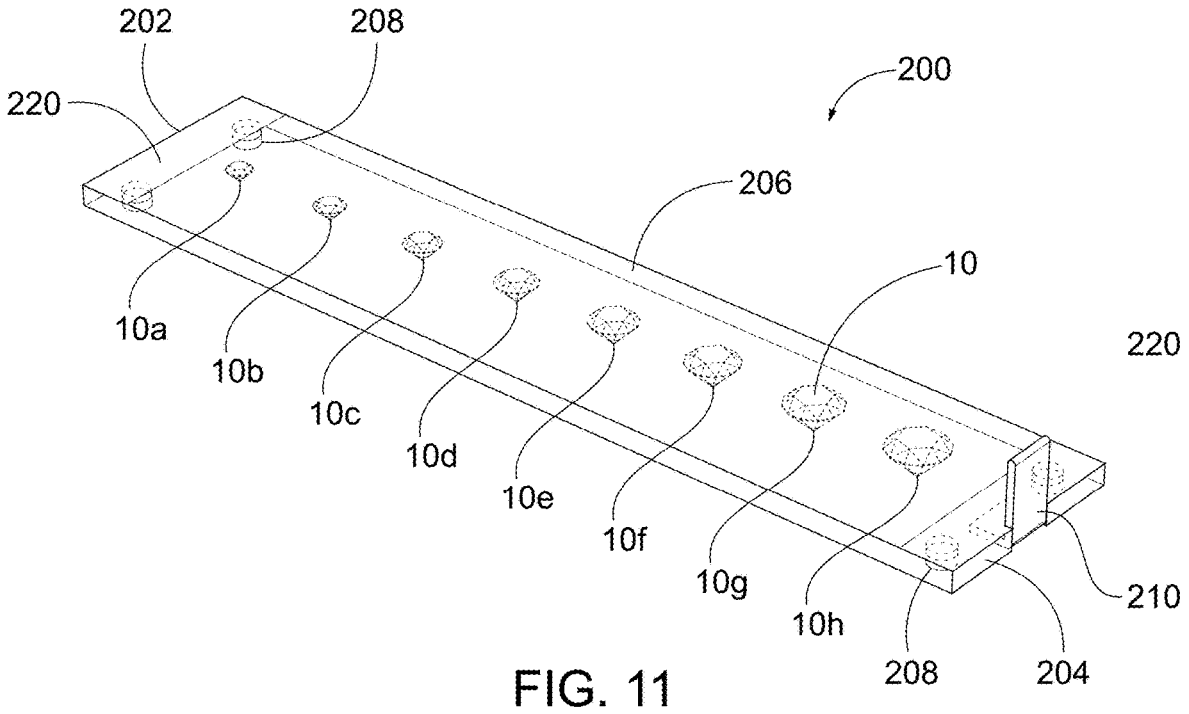
FIG. 11 is an exemplary implementation of a viewing card having a plurality of stones according to an embodiment as described herein.
Figure 12:
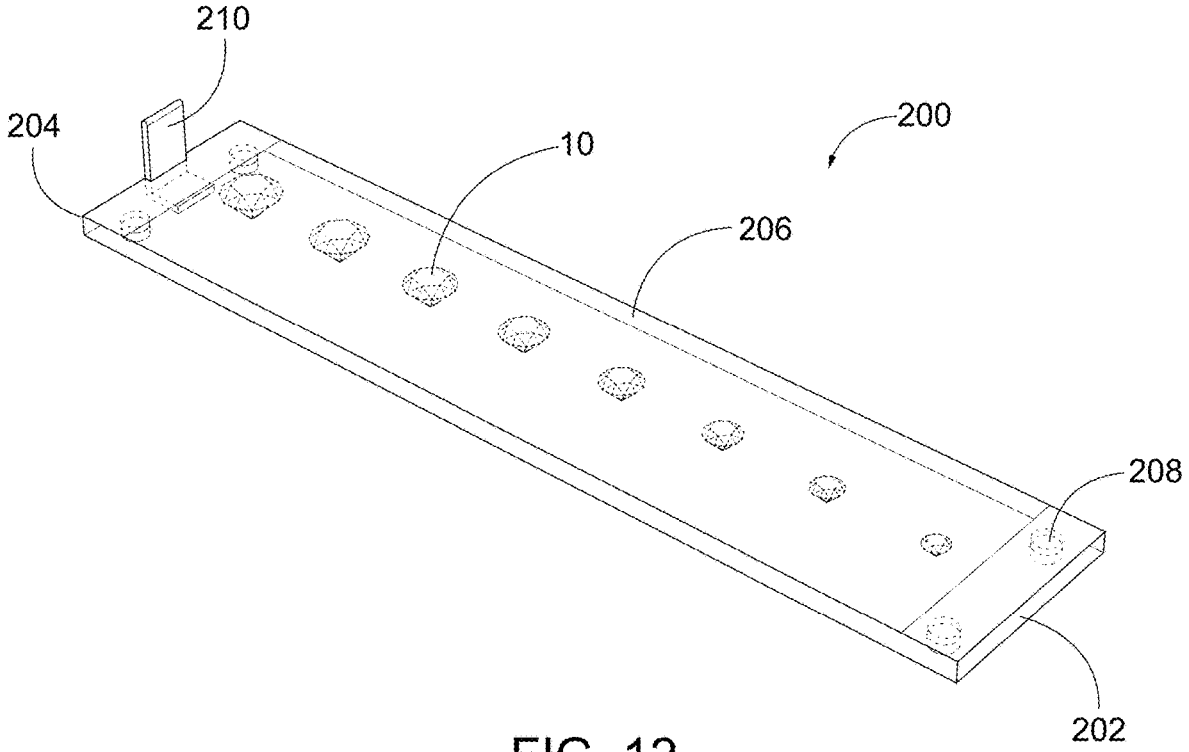
FIG. 12 is another exemplary implementation of a viewing card having a plurality of stones according to an embodiment as described herein.
Figure 13:
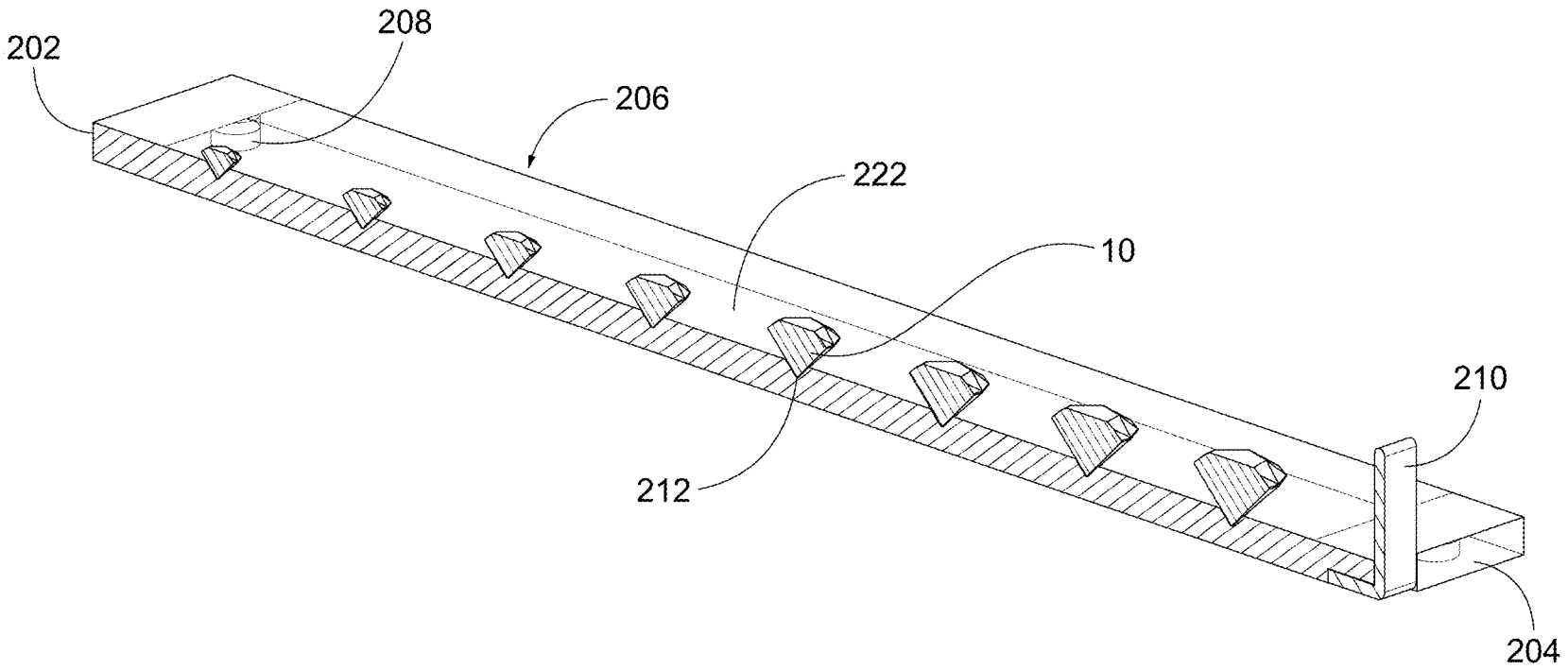
FIG. 13 is a cross-sectional view of an implementation of a viewing card having a plurality of stones according to an embodiment as described herein.

FIGS. 11-13 illustrate an exemplary display card 200 according to an embodiment. The display card 200 may include a first end 202, a second end 204, and a body 206 extending from the first end 202 to the second end 204. The body 206 of the display card 200 can be any suitable material to allow a user to see through the body 206 for viewing purposes. By way of example, the body may manufactured from a clear and transparent material such as acrylic plastic (e.g., Plexiglas®). In other embodiments, the body 206 is manufactured from glass, polycarbonate, styrene, or any other suitable clear material. Although the material of the display card 200 and the body 206 may be any material, in a preferred embodiment, the body 206 is manufacturing from a substantially rigid and clear material so that a user may see through the body 206 of the display card 200.

The display card 200 may be configured to hold at least one precious stone 10. As described above, precious stones 10 may be cubic zirconia stones, diamonds, or any other precious stone desired to be viewed by a user. As illustrated, in an embodiment the display card 200 comprises eight precious stones 10*a*-10*h* attached to the body 206 of the display card 200. Each precious stone 10*a*-10*h* may be or represent a specific cut of stone, and each precious stone 10*a*-10*h* may be or represent a different attribute such as carat weight, size, color, or clarity. By way of example and not limitation, the precious stone 10*a* may be a 0.50 carat round brilliant cut diamond, the precious stone 10*b* may be a 1.0 carat round brilliant cut diamond, the precious stone 10*c* may be a 1.5 carat round brilliant cut diamond, the precious stone 10*d* may be a 2.0 carat round brilliant cut diamond, the precious stone 10*e* may be a 2.5 carat round brilliant cut diamond, the precious stone 10*f* may be a 3.0 carat round brilliant cut diamond, the precious stone 10*g* may be a 4.0 carat round brilliant cut diamond, and the precious stone 10*h* may be a 5.0 carat round brilliant cut diamond. It should be appreciated that each precious stone 10*a*-10*h* may be any suitable carat weight according to desired viewing needs. Moreover, each precious stone 10 may be any suitable cut of diamond or stone. For instance, the precious stone 10 can be a cushion cut, radiant cut, emerald cut, round cut, princess cut, oval cut, asscher cut, marquise cut, pear cut, heart cut, or any suitable cut without deviating from the scope of the disclosure. Each display card 200 may comprise a particular cut of stone 10 such that one or more display cards 200 within the display device 100 may comprise a different cut of stone 10 from one or more other display cards 200.

It should be appreciated that each precious stone 10*a*-10*h* may be used to illustrate and display any suitable attribute of a stone in addition to carat weight or size. Such additional attributes may include color or clarity of a stone. For example, color may refer to the color (or absence of color) of a stone and may be graded on a scale from D (colorless) to Z (most color). In an embodiment, each precious stone 10*a*-10*h* may represent a different color on the color scale to illustrate the differences in color. Similarly, clarity may refer to the presence or absence of internal inclusions and surface blemishes on a stone. The scale may range from Internally Flawless to Included, as known in the industry. In an embodiment, each precious stone 10*a*-10*h* may represent a different clarity on the clarity scale to illustrate the differences in clarity. The display card may include text or other visual indication adjacent to each stone 10*a*-10*h* to identify one or more particular attributes such as the stone carat weight, size, color, and/or clarity. In an embodiment, one or more of the stones 10*a*-10*h* may be displayed in a two-dimensional representation on the display card 200, to illustrate and display attributes of the stone such as the stone carat weight, size, color, and/or clarity. For example, the display card 200 can include one or more two-dimensional images of gemstones printed on or otherwise attached to the display card 200.

The display card 200 may further comprise at least one attachment device such as at least one magnet 208 for removably attaching or affixing the display card 200 to a display case 100. The magnets 208 may be located within the body 206 proximate the first end 202 and the second end 204. To hide the magnets 208 from view, sheets 220 may be placed over the top of the surface of the body 206. The sheets 220 may also hold the magnets 208 within the body 206 of the display card 200. According to an embodiment the sheets may be made of any suitable material for covering the magnets. In other examples, the magnets 208 may be affixed to the body 206 in another suitable manner such as with adhesive, glue, or tape. As illustrated in FIGS. 11-13, in an embodiment there are two magnets 208 proximate the first end 202 and two magnets 208 proximate the second end 204, although any number of magnets 208 may be used without deviating from the scope of the disclosure. According to an embodiment, positioning the magnets 208 within the body 206 allows the display card 200 to lay flat on the surface 138 of the display case. In other embodiments, other suitable attachments methods may be used to secure the display card 200 to the display case 100, such as hook and loop fasteners, for example.

The display card 200 may also comprise at least one pull tab 210 to facilitate removal of the display cards 200 from the display case 100. The pull tab 210 may be located at the second end 204 of the display card 200. It should be appreciated that although one pull tab 210 is shown, any number of pull tabs 210 may be used. For instance, in other embodiments, the display card 200 may have one pull tab 210 proximate the first end 202 and a second pull tab 210 proximate the second end 204. Additional information regarding the installation of the display card 200 in the display case 100 will be discussed below.

FIG. 13 is a cross sectional view of the display card 200 according to an embodiment. As illustrated, each of the precious stones 10 may be affixed to the body 206 of the display card 200. An opening or cutout 212 may be made into the surface 222 of the body 206 and sized so that at least a portion of each of the precious stones 10 may extend below the surface 222 of the display card 200. The cutout 212 may correspond to the shape and size of each stone 10*a*-10*h*, so that each stone is suitably affixed to the display card 200. It should be appreciated that various diamonds, stones, or other emeralds often have angled or non-flat culet or pavilion surfaces, making attachment to a flat surface difficult. According to an embodiment, inserting the stones 10*a*-10*h* into the cutouts 212 may allow more surface area of the precious stone 10 to attach to the display card 200. For instance, a portion of the pavilion surface of the precious stones 10 may engage a portion of the cutout 212 to secure the precious stones 10 to the display card 200. The precious stones 10 may be further secured to the body 206 and/or to a surface of the cutout 212 via adhesive and/or pressure fit. In other embodiments, diamond settings may be used to attach the precious stones 10 to the display card 200. In still other embodiments, the precious stones 10 may be removably attached to the display card 200 to allow for ease of installation or removal of precious stones 10 to the display card 200. In still other embodiments, the precious stones 10 may be visually represented by one or more two-dimensional images on the display card 200.

Figure 14:
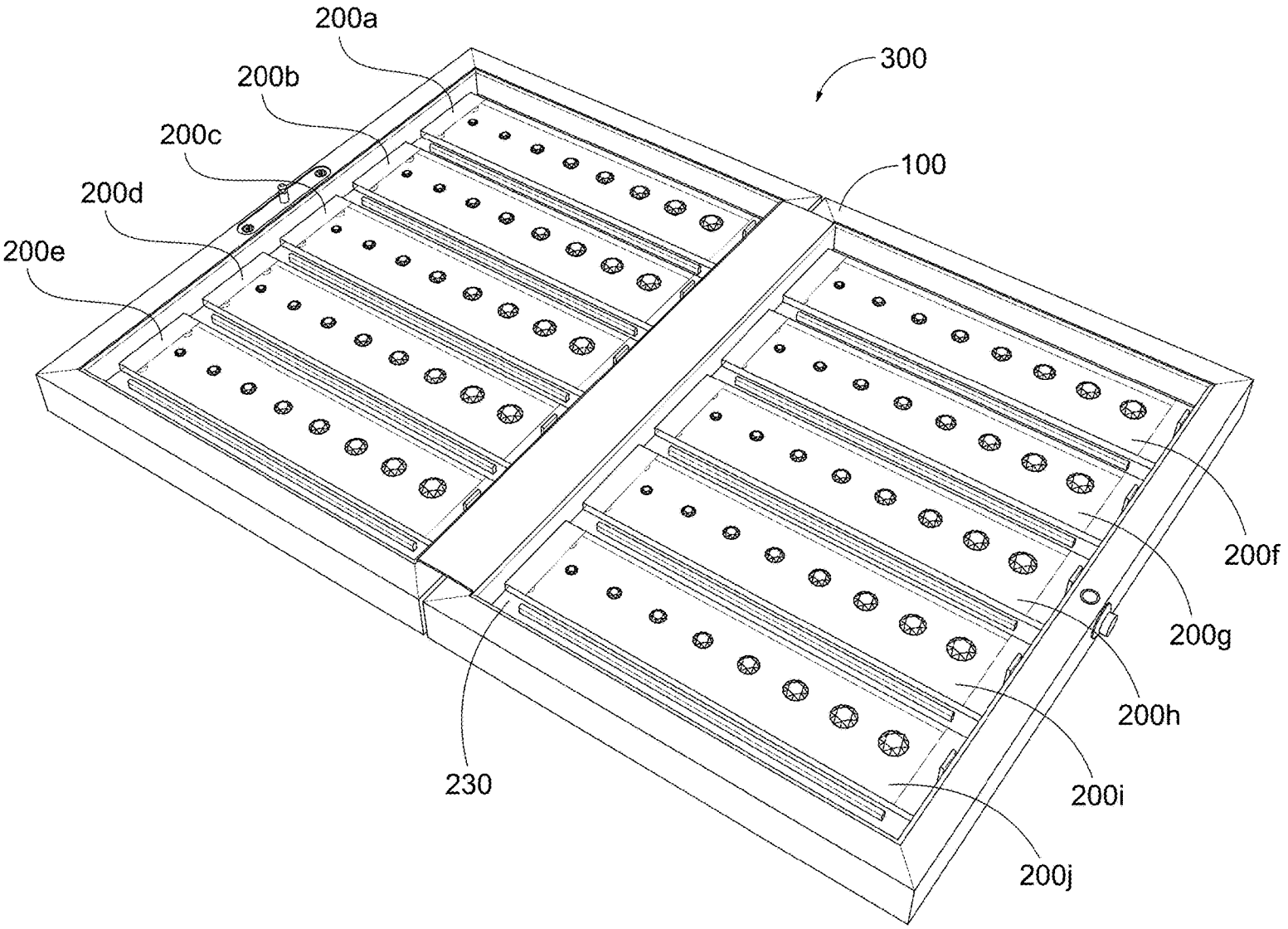
FIG. 14 is an exemplary implementation of the display case having a plurality of viewing cards according to an embodiment as described herein.
Figure 15:
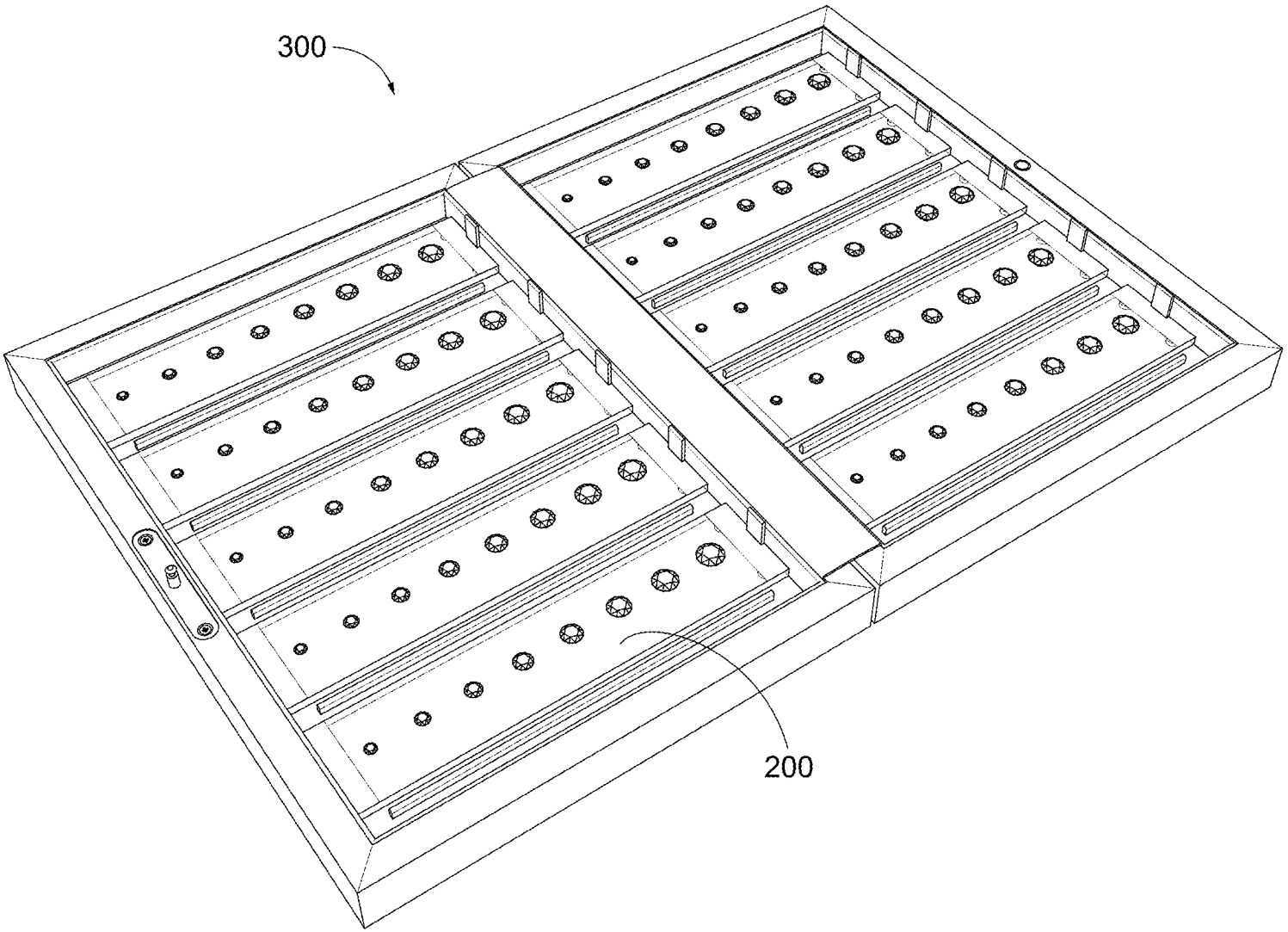
FIG. 15 is another exemplary implementation of the display case having a plurality of viewing cards according to an embodiment as described herein.

Turning to FIGS. 14-15, a system 300 comprising the display case 100 and a plurality of display cards 200 according to an embodiment is shown. According to an embodiment, the system 300, as illustrated, comprises ten display cards 200*a-j*, with each portion 102 and 104 of the display case 100 holding five display cards 200. As discussed above, in an embodiment each display card 200 is installed between a pair of protrusions or ribs 114 to hold the display card 200 in place. For instance, the ribs 114 may prevent rotational and lateral movement of the display cards 200 with respect to the display case 100. Additionally, the magnets 208 of the display cards 200 may engage with corresponding magnetic surfaces of the display case 100 to hold the display cards 200 to the surface 138 of the display case 100. The corresponding magnetic surfaces of the display case 100 may be magnets or may be a ferromagnetic material to which the magnets 208 are attracted to.

The plurality of display cards 200*a-j* may each display or hold a plurality of precious stones 10. In an embodiment, each display card 200 may display or hold a different cut of stone. For example, display card 200*a* may display or hold a variety of cushion cut stones, display card 200*b* may display or hold a variety of radiant cut stones, display card 200*c* may display or hold a variety of emerald cut stones, display card 200*d* may display or hold a variety of round cut stones, display card 200*e* may display or hold a variety of princess cut stones, display card 200*f* may display or hold a variety of oval cut stones, display card 200*g* may display or hold a variety of asscher cut stones, display card 200*h* may display or hold a variety of marquise cut stones, display card 200*i* may display or hold a variety of pear cut stones, and display card 200*j* may display or hold a variety of heart cut stones. Each display card 200 may further display each cut of stone in a variety of different carat weights or size, and the stones may be arranged according to any suitable ordering, such as ordered in sequential order from lowest carat weight to highest. In one example, the display card 200*c* displays eight emerald cut stones 10 ranging from 0.5 carat to 5.0 carat.

Although the figures illustrate ten display cards 200, it should be appreciated that the display case 100 can be configured to hold or display any suitable number of display cards 200. Likewise, although the drawings illustrate eight precious stones 10 per display card 200, it should be appreciated that any number of precious stones 10 can be displayed on the display card 200 without deviating from the scope of the disclosure.

To remove the display cards 200 from the display case 100, a user may pull on the pull tab 210. This may, for example, assist with breaking the bond between the magnets 208 and the magnetic or ferromagnetic material of the display case 100. To install the display cards 200, the user can place the display card 200 between a pair of ribs 114 until the magnetic forces pull the display card 200 to the surface of the display case 100 for attachment thereto.

Figure 16:
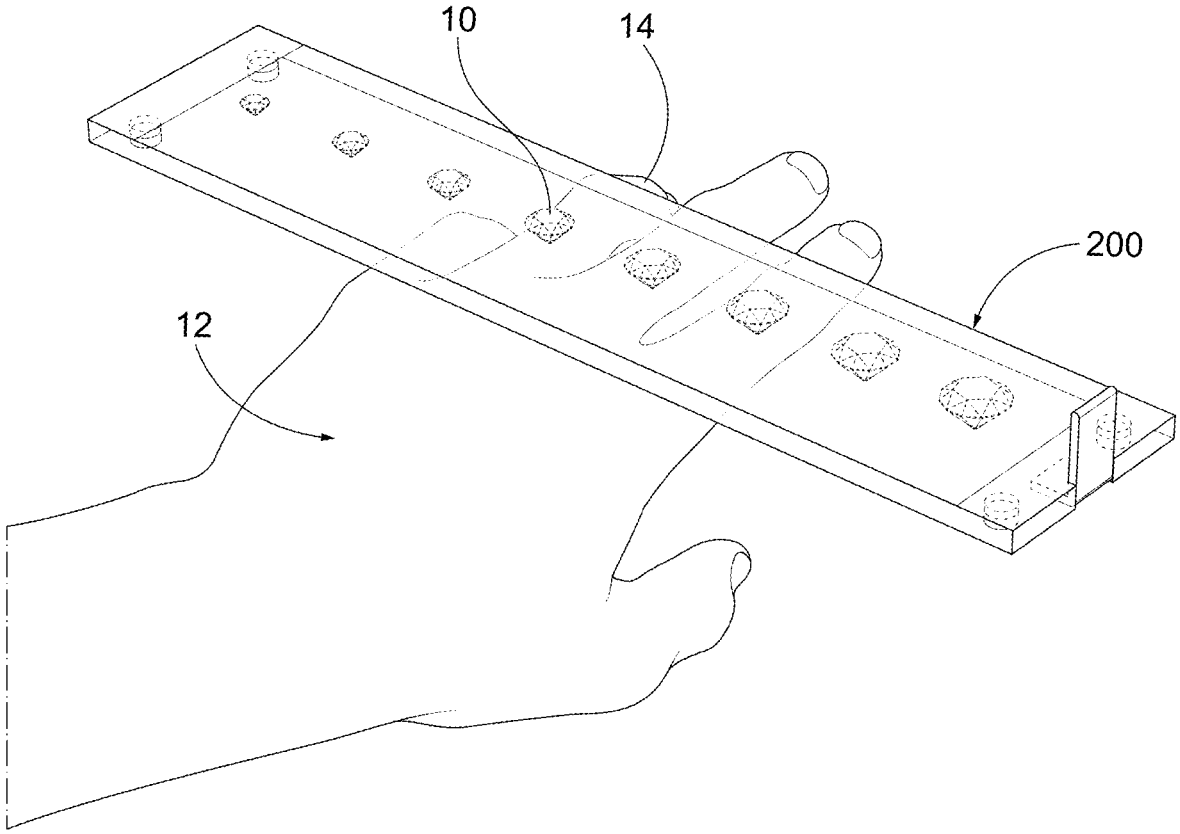
FIG. 16 is an exemplary implementation of a viewing card placed over a user's finger according to an embodiment as described herein.

FIG. 16 illustrates the display card 200 placed over the top of a user's hand 12 according to an embodiment. It should be appreciated that the user can see her or his hand 12 through the display card 200 for viewing purposes. Therefore, the user may view each precious stone 10 over the top of the ring finger 14 (or any other finger or portion of the hand as desired) to determine appropriate sizing and cut of the precious stone 10 with respect to the user's finger 14. Although any non-clear surface could be used to manufacture the display card 200, according to an embodiment it may be beneficial to use a clear material for manufacture so that a user can see her or his hand through the body 206 of the display card 200 for an improved viewing experience.

Those in the industry will appreciate the advantages and convenience of a display device including at least one display card displaying or having a plurality of stones 10 of different attributes such as different cuts, sizes, and carat weights, conveniently located on the display cards 200. To view different precious stones 10 on the user's finger 14, the user can laterally move the display card 200 to align a desired precious stone 10 over the top of the finger 14 to view the precious stone on the user's finger 14. To view a different cut of stone 10, the user can switch to a different one of the plurality of display cards 200.

By way of example, a method of testing or viewing stones 10 may include a user opening the display case 100 and selecting a first display card 200*a* of a plurality of display cards 200. The first selected display card 200*a* may display or include eight cushion cut cubic zirconia stones 10 with progressively increasing carat weights and sizes. The user may then selectively position the display card 200*a* over the user's hand to align a first cushion cut cubic zirconia stone 10*a* having a first carat weight over the top of the user's ring finger 14, to observe the look of the first cushion cut cubic zirconia stone 10*a* on the user's finger 14. The user may then align, by laterally translating the display card 200*a*, a second cushion cut cubic zirconia stone 10*b* having a second carat weight over the top of the user's ring finger 14 to observe the look of the second cushion cut cubic zirconia stone 10*a* on the user's finger 14. This may continue for as many stones 10 are present on the display card 200*a*, enabling the user to compare the look of several different stones on the user's finger. When complete, the user may place the display card 200*a* back into the display case 100.

According to an embodiment, to view a different cut of stone, the user may select a second one 200*b* of a plurality of display cards 200. The second selected display card 200*b* may display or include eight princess cut cubic zirconia stones 10 with progressively increasing carat weights and sizes. The user may then selectively position the display card 200*a* over the user's hand to align a first princess cut cubic zirconia stone 10*a* having a first carat weight over the top of the user's ring finger 14 to observe the look of the first princess cut cubic zirconia stone 10*a* on the user's finger 14. The user may then align, by laterally translating the display card 200*b*, a second princess cut cubic zirconia stone 10*b* having a second carat weight over the top of the user's ring finger 14, to observe the look of the second princess cut cubic zirconia stone 10*a* on the user's finger 14. This may continue for as many stones 10 are present on the display card 200*b*. When complete, the user may place the display card 200*b* back into the display case 100.

The above steps may be repeating for all display cards 200*a* through 200*j* or for a select number of displays cards 200 according to a user preference.

The foregoing description has been presented with reference to various embodiments. The embodiments were chosen and described in order to explain the principles of the invention and its practical application. The foregoing description is not intended to be exhaustive or to limit the invention to the precise forms disclosed. Further, while the various embodiments describe particular combinations of features of the invention it should be understood that different combinations of the features will be apparent to persons skilled in the relevant art as within the scope of the invention such that features of one embodiment may be incorporated into another embodiment. Moreover, it will be apparent to persons skilled in the art to which this invention pertains various additions, subtractions, deletions, variations, and other modifications and changes in form, detail, implementation and application can be made therein without departing from the spirit and scope of the invention. It is intended that the broader spirit and scope of the invention be defined by the following claims and their equivalents.

What is claimed is:

1. A jewelry display system, comprising:

at least one display card comprising a first end, a second end opposite the first end, and a substantially transparent body disposed between the first and the second ends, the display card further comprising a plurality of precious stones disposed at least partly within the body, wherein at least one precious stone of the plurality of precious stones has one or more attributes different from other stones of the plurality of precious stones and the plurality of precious stones are arranged on the display card according to an ordering; and a display case comprising a plurality of parallel ribs that define card-receiving slots sized to receive opposing longitudinal edges of the at least one display card, and the at least one display card is removably coupled to the display case between two of the plurality of parallel ribs, and wherein removal of the at least one display card permits selective positioning and viewing of each of the plurality of precious stones arranged on the display card.

2. The jewelry display system of claim 1, wherein the one or more attributes comprises a carat weight, a size, a clarity, or a color of a precious stone.

3. The jewelry display system of claim 1, wherein there are at least two display cards, each of the at least two display cards comprising a plurality of precious stones disposed at least partly within the body, wherein each precious stone is a different carat weight and each of the plurality of precious stones are arranged on each respective display card in order of progressively increasing carat weight.

4. The jewelry display system of claim 3, wherein a first display card of the at least two display cards comprises a plurality of precious stones having a first cut and a second display card of the at least two display cards comprises a plurality of precious stones having a second cut.

5. The jewelry display system of claim 4, wherein the first cut is a cushion cut and the second cut is a round cut.

6. The jewelry display system of claim 1, wherein the display case comprises a first portion and a second portion, and a hinge element to facilitate movement of the first portion with respect to the second portion, the display case having an opened position and a closed position.

7. The jewelry display system of claim 6, wherein the display case comprises a locking mechanism to lock the first portion to the second portion when the display case is in the closed position.

8. The jewelry display system of claim 1, wherein the at least one display card comprises at least one first magnet proximate the first end and at least one second magnet proximate the second end, the at least one first magnet and at least one second magnet configured to hold the at least one display card within the display case.

9. The jewelry display system of claim 8, wherein the at least one display card comprises at least one tab for removal of the at least one display card from the display case.

10. The jewelry display system of claim 1, wherein the body of the at least one display card comprises a plurality of openings, each of the plurality of openings configured to accept a portion of a respective precious stone to attach of the respective precious stones to the body of the display card.

11. The jewelry display system of claim 10, wherein each of the openings extend partially into the body of the at least one display card, each opening being sized according to a respective precious stone, including at least part of a pavilion of the precious stone, to secure the precious stone at least partially within the body of the display card.

12. A jewelry display system, comprising:

a first display card comprising a first end, a second end opposite the first end, a substantially transparent body disposed between the first and the second ends, a first magnet proximate the first end, and a second magnet proximate the second end, the first display card further comprising a plurality of precious stones of a first cut disposed at least partly within the body, wherein each precious stone is a different carat weight and each of the plurality of precious stones are arranged on the first display card according to carat weight;

a second display card comprising a first end, a second end opposite the first end, a substantially transparent body disposed between the first and the second ends, a first magnet proximate the first end, and a second magnet proximate the second end, the second display card further comprising a plurality of precious stones of a second cut disposed at least partly within the body, wherein each precious stone is a different carat weight and each of the plurality of precious stones are arranged on the second display card according to carat weight; and a display case comprising a plurality of ribs arranged parallel to one another to create a space between the plurality of ribs for receiving opposing longitudinal edges of the first and the second display cards, the first and the second display cards are removably coupled to the display case via magnetic attraction between the first and second magnets of the first and second display cards and a respective portion of the display case, and wherein removal of the first or second display card permits selective positioning and viewing of each of the plurality of precious stones arranged on the first or second display card.

13. The jewelry display system of claim 12, wherein each of the plurality of precious stones are Cubic Zirconia stones.

14. The jewelry display system of claim 12, wherein the first cut is different from the second cut.

15. The jewelry display system of claim 12, wherein the first cut is a cushion cut and the second cut is a round cut.

16. The jewelry display system of claim 12, wherein the display case has a first portion and a second portion, and a hinge element to facilitate movement of the first portion with respect to the second portion, the display device-case having an opened position and a closed position.

17. The jewelry display system of claim 16, wherein the display case comprises a locking mechanism to lock the first portion to the second portion when the display case is in the closed position.

18. The jewelry display system of claim 12, wherein the first and the second display cards each comprise at least one tab for removal of the first or second display cards from the display case.

19. The jewelry display system of claim 12, wherein the body of each of the first and the second display cards comprises a plurality of openings, each of the plurality of openings configured to accept a portion of a respective precious stone to attach the portion of the respective precious stone to the body of the respective first or second display card.

20. The jewelry display system of claim 19, wherein each of the openings extend partially into the body of the respective first or second display cards, each opening being sized according to a respective precious stone, including at least part of a pavilion of the precious stone, to secure the precious stone at least partially within the body of the display card.

* * * * *